United States Patent [19]

Ursillo

[11] 4,380,153

[45] Apr. 19, 1983

[54] TOTAL ENERGY HEATING UNIT

[76] Inventor: Henry G. Ursillo, 306 Ipswich Rd., Boxford, Mass. 01921

[21] Appl. No.: 200,155

[22] Filed: Oct. 24, 1980

[51] Int. Cl.[3] ..... F01K 17/00

[52] U.S. Cl. ..... 60/648; 60/669; 126/101; 237/12.1

[58] Field of Search ..... 126/66, 67, 112, 110 R, 126/101; 122/40; 60/669, 670, 648; 237/12.1

[56] References Cited

U.S. PATENT DOCUMENTS

| | | | |
|---|---|---|---|
| 545,296 | 8/1895 | Kintner | 237/12.1 X |
| 1,676,046 | 7/1928 | Phillips | 122/40 X |
| 4,180,052 | 12/1979 | Henderson | 126/67 X |

*Primary Examiner*—Allen M. Ostrager
*Assistant Examiner*—Stephen F. Husar
*Attorney, Agent, or Firm*—Dahlen & Gatewood

[57] ABSTRACT

A total energy heating unit which provides not only heat but also hot water and electricity is set forth. A single source of fuel is used such as coal, wood, or even compact dry leaves. The fuel is burned in an airtight firebox surrounded on three sides by a hot air containment unit, in which is located a means for generating steam. On top of the firebox is located an enclosure for water circulating tubes. As the fuel burns, it not only furnishes heat for heating air forced through the containment unit and then into a ducting system, but also provides hot air for heating water circulating to a hot water storage tank, and heat for heating a metal block which, when impinged with water droplets, results in generating steam for operation of a steam turbine for the generation of electricity.

21 Claims, 19 Drawing Figures

TOTAL ENERGY HEATING UNIT

BACKGROUND OF THE INVENTION

1. Field of the Invention

This invention relates to a total energy heating unit, e.g., a stove or furnace, in particular a heating unit that will not only provide heat but also hot water and electricity as well.

2. Description of the Prior Art

Over the past several years, and particularly since the beginning of the so-called "energy crisis", there has been an ever increasing interest in energy conservation and development. While much of that interest was generated initially due to the shortage and increasing price of gasoline, individuals, and particularly homeowners, now more fully realize just how dependent they have become upon oil, as an energy source. Thus, the shortage of oil and its ever increasing price has resulted not only in increased gasoline prices, and the attendant increased cost in operating an automobile, but also increases of the same magnitude in the purchase of home heating oil. And, as much electricity is generated by a power plant's use of oil, not only has the homeowner found it dramatically more costly in recent years to heat his home, it also costs more for electricity.

As a result of the ever increasing cost of oil, many homeowners have sought ways to avoid, or at least alleviate in some way, their dependence upon oil as a major source of fuel. Accordingly, there has been an increasing interest in and a return to coal and wood, as a fuel source, particularly in the heating of one's home. Thus, there have developed in more recent years a variety of coal and wood burning stoves, and a return to using such stoves as were used years ago, particularly as space heaters, in the heating of an individual room.

In many parts of the country where coal was plentiful, and particularly before the environmentalists concern with the use of coal, and coal became more costly than oil to use, homes were commonly centrally heated with coal burning furnaces. And the heat generated from the burning coal was used either to provide forced air central heating or convection heating by means of circulating hot water.

SUMMARY OF THE INVENTION

In accordance with the basic aspects of my invention there is provided an all purpose, highly efficient heating unit which, most advantageously, does not depend upon oil as a source of fuel. The heating unit provides not only heat, i.e., forced hot air, but also hot water as desired, and as a further by-product, it will provide a controlled supply of electricity at a rate to satisfy the average dwelling. Thus, as a result of this invention, a total energy heating unit is provided, one particularly suitable for residential usage.

The heating unit of the invention uses only one source of fuel, e.g., generally wood, or coal. However, compacted dry leaves and other dry vegetation and waste will also be found satisfactory for use in the heating unit of this invention. As a result of the efficiency of the heating unit and its capability of deriving from one fuel source not only heated air but also heated water and electricity, the dependence upon fossil fuels will be somewhat reduced, as will one's total energy cost.

The total energy heating unit of the invention comprises in its basic aspects in combination a firebox assembly in which is located a steam tank for the generation of steam, for supplying a steam turbine which operates in turn a generator for the production of electricity, a hot air containment unit surrounding the firebox on three sides for supplying forced hot air through a distributing duct system, and an enclosure for water circulating tubes associated with the top of the firebox whereby the water can be heated as desired by heat from the firebox that would otherwise not be used.

In the more preferred aspects of the invention there is provided in the steam tank a unique manner of generating a continuous and controlled supply of steam. Thus, there is provided in the steam tank a heating block which on being sprayed with a fine spray of water converts the water immediately to steam.

In yet a further aspect of the invention, there are provided for use in the steam turbine rotors of unique construction making them particularly suitable in the practice of the invention.

BRIEF DESCRIPTION OF THE DRAWING

The invention is described in greater detail hereinafter, reference being made to the drawing, to facilitate understanding of the invention, in which.

DETAILED DESCRIPTION OF THE INVENTION AND THE PREFERRED EMBODIMENTS

Figure 1:
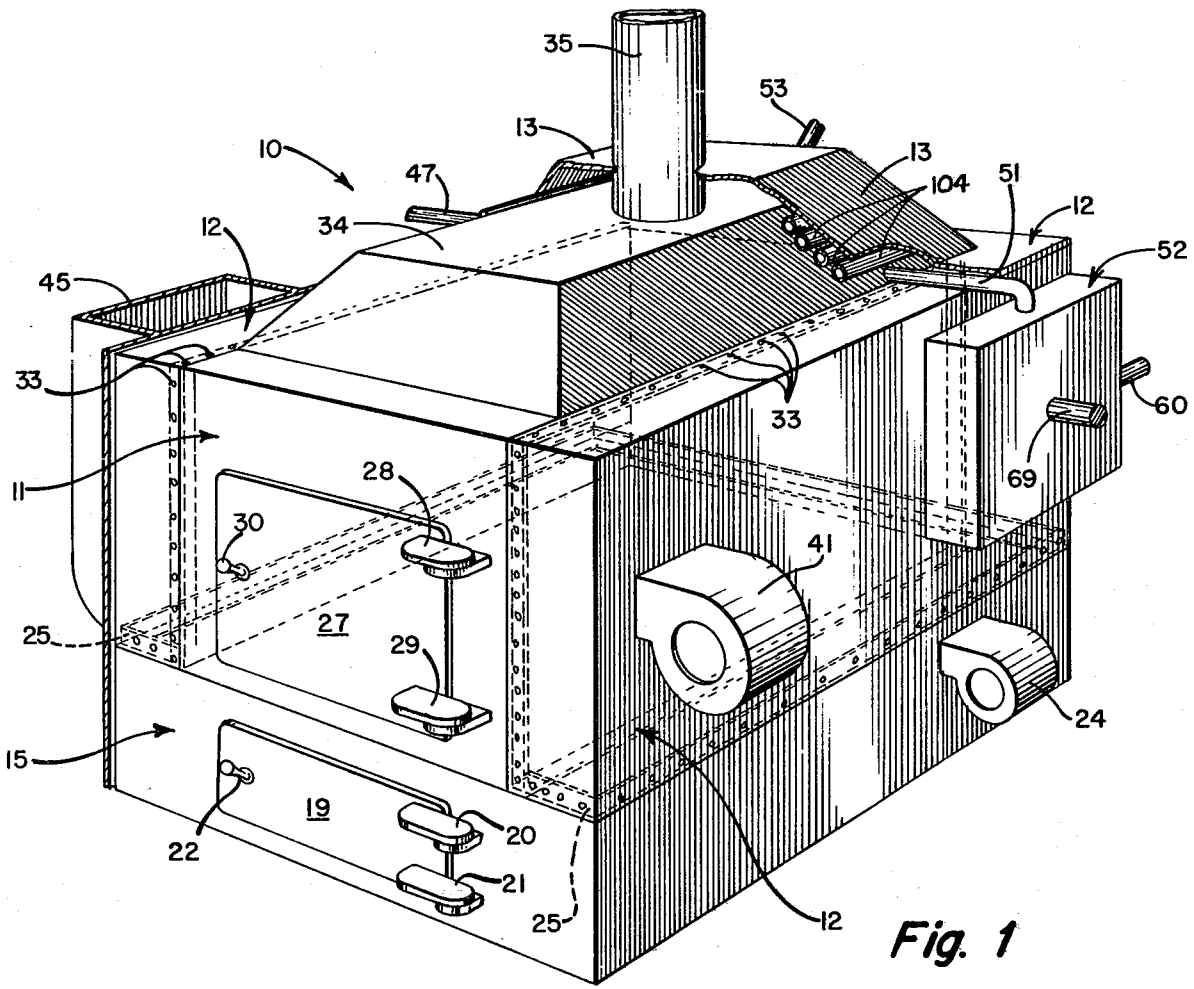
FIG. 1 is a view in perspective showing the total energy heating unit of the invention with the top cover and insulation cut away for sake of clarity in disclosing the invention.
Figure 4:
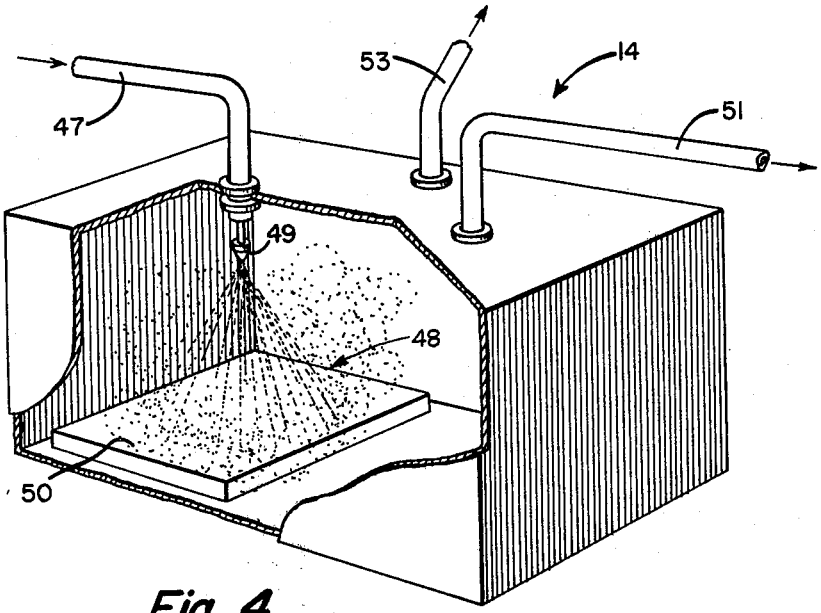
FIG. 4 is a view in perspective of the steam tank located inside the firebox assembly shown in FIG. 2 with a portion thereof cut-away so as to show the heating block which is used in the generation of steam.

Turning now to the drawings, there is shown in FIG. 1 thereof a total energy heating unit 10 in accordance with my invention comprising in its most basic aspects a firebox assembly 11, a hot air containment unit 12 surrounding the firebox on three sides, a top cover 13 for the enclosure of water circulating tubes (partially broken away in FIG. 1 for sake of clarity), and a steam tank 14 (FIGS. 2 and 4) for supplying steam for the generation of electricity, as hereinafter more fully described.

Figure 3:
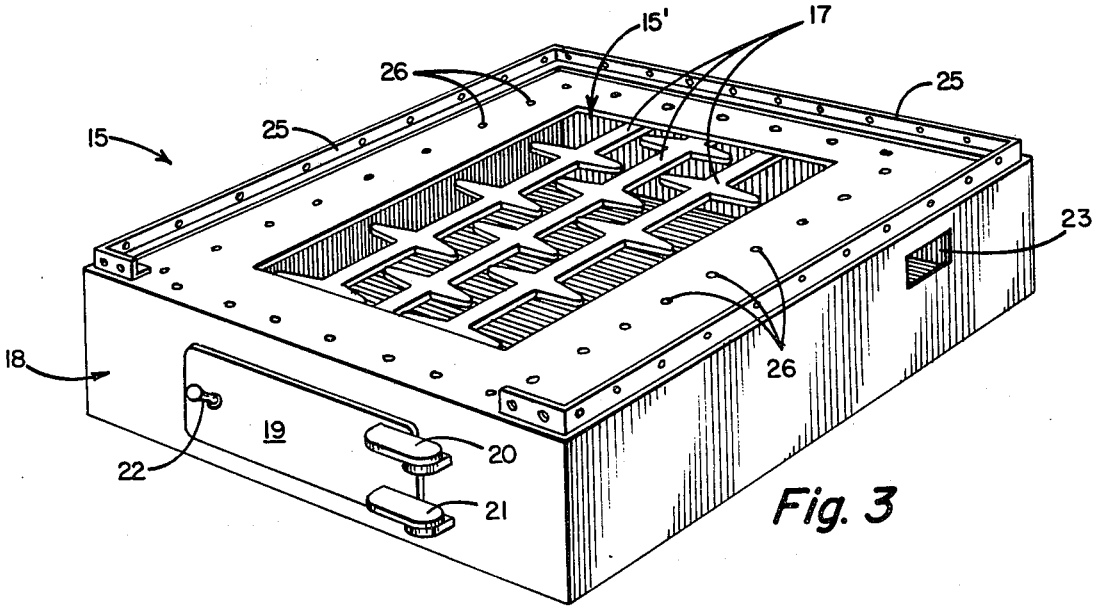
FIG. 3 is a view in perspective showing only the base assembly of the heating unit shown in FIG. 1 which assembly is used to support the firebox assembly and hot air containment unit.

As disclosed in FIG. 1 firebox assembly 11 and hot air containment unit 12 are supported by base assembly 15 in the top surface of which is provided a rectangular-shaped opening 15′ coextensive with opening 16 in the base of firebox assembly 11. Located in opening 15′, as seen by reference to FIG. 3 are conventional furnace grates 17; and, in the front end 18 of the base assembly is located clean-out door 19 hingedly connected in usual fashion by hinges 20, 21 and having handle 22 therein for opening and closing of the door, for the cleaning and removal of ashes. In the side of base assembly 15 is provided rectangular-shaped opening 23 for the discharge of forging air from fan 24 into base assembly 15 and up through opening 15′ through the burning fire of coal, wood, or other fuel.

Along the perimeter of the top surface of base assembly 15 is bolted in conventional fashion L-shaped flange 25 for connection of the base assembly with hot air containment unit 12. Holes 26, as shown, are match drilled according to usual techniques in the top surface of the base assembly for bolting firebox assembly 11 to the base. When assembled together base assembly 15, firebox assembly 11, and hot air containment unit 12 will be sealed air tight and clean out door 19 will, when closed, be sealed, as will opening 23 on positioning of fan 24 therein.

Figure 2:
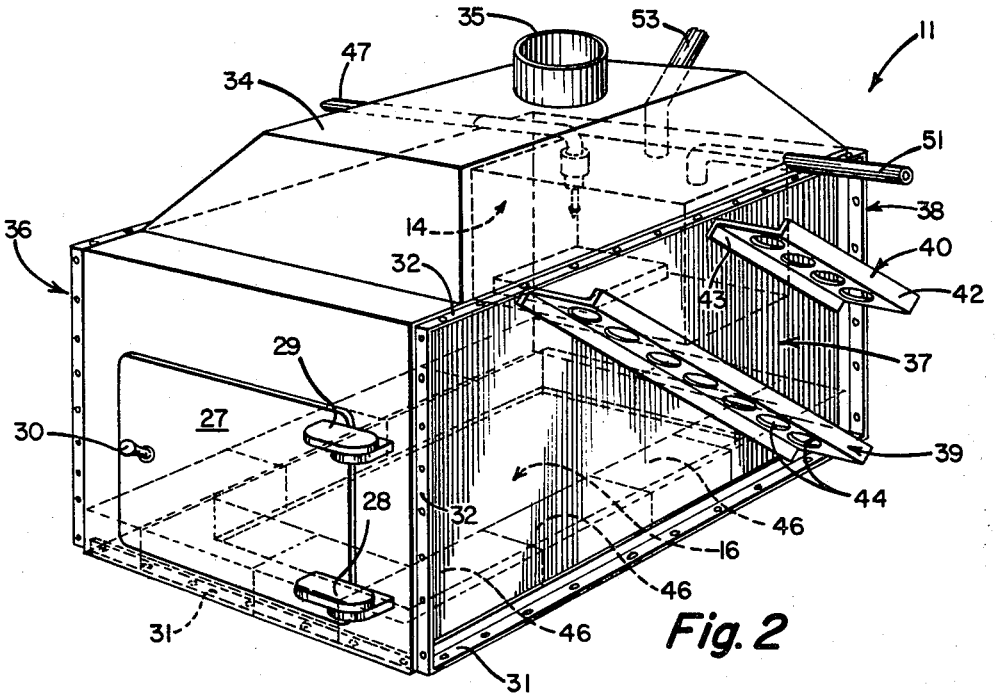
FIG. 2 is a view in perspective of the firebox assembly of the heating unit shown in FIG. 1 with the hot air containment unit, top cover, and base assembly removed therefrom.

Firebox assembly 11, as shown more clearly in FIG. 2 of the drawing, is substantially a rectangular-cubic shape in the bottom surface of which is provided opening 16 which, as before-disclosed, matches with opening 15′ in base assembly 15. In the front end of firebox assembly 11 is provided sealed door 27 for loading of fuel into the firebox. Door 27 is hingedly attached to the firebox assembly by hinges 28, 29, and is opened and closed in usual fashion by means of handle 30. L-shaped flanges as represented by reference 31, 32, are bolted along respective bottom and vertical edges of firebox assembly 11 in order to mount, according to conventional bolting techniques, the firebox assembly 11 to base assembly 15 and hot air containment unit 12 to firebox assembly 11, the latter as shown by bolts 33. Thus, as earlier disclosed, there will be provided an airtight assembly.

The top surface 34 of firebox assembly 11 is preferably, as shown, in cross-section, of a trapezoidal shape, for a purpose which will be made clear later on. However, as will be appreciated, it need not necessarily be of that particular shape so long as the same purpose is achieved. In the rear of top surface 34 of firebox assembly 11 there is provided flue 35 for venting of combustion gases according to usual techniques.

On the two sides 36, 37 of firebox assembly 11, and on the rear end 38 thereof, there are provided aluminum baffles, as represented by reference numerals 39, 40. It will be appreciated, however, that these baffles can be of other material than aluminum, if desired, so long as the same purpose is achieved. The baffles serve to disturb the relatively stagnant air discharged from fan 41 into hot air containment unit 12 and provide more efficient heating thereof. Each of the baffles is provided with flanges, as indicated by reference numerals 42, 43, for mounting of the baffles to the inside surface of hot air containment unit 12 and the outside surface of firebox assembly 11, respectively. The baffles are provided along their length with spaced-apart openings 44 for passage of the air introduced by fan 41 through the hot air containment unit and around the outside surface of the firebox assembly so that the air will be desirably heated, prior to discharge from the hot air containment unit through hot air duct 45, into ducts for distributing the heated air through the house or other building construction which is to be heated.

Although two baffles are shown in the drawing, it will be appreciated by those skilled in the art that a greater number or fewer can be provided, as desired. However, two baffles have been found quite satisfactory in the practice of the invention, these being angled as shown at an inverse acute angle $\alpha$ of approximately 75° from the horizontal. One of the baffles, as indicated, can be longer than the other, and extends substantially diagonally across the side of the firebox assembly from the upper to the lower corner. The other, shorter, baffle can extend upwardly from about the mid-point of the vertical edge, as is shown. Though not shown in the drawing, a similar baffle is positioned on rear end 38 of firebox assembly 11 which extends diagonally at the same angle as baffle 39, from the upper corner of end 38 to the lower corner thereof, facing the end 38 of the firebox assembly. And, a single baffle (also not shown) is provided also on side 36 of firebox assembly 11 which baffle extends diagonally substantially from the upper corner thereof to the lower corner, except that its direction is the reverse of diagonal 39.

Internally, the bottom supporting surface of firebox assembly 11 is constructed of firebrick 46, according to usual techniques. Most importantly, however, and a critical feature of the invention, inside firebox assembly 11 there is located steam tank 14 for the generation of steam and the ultimate production of electricity, as hereinafter more fully disclosed. Steam tank 14, as shown in FIG. 2 of the drawing, is supported on the inside of rear end wall 38 of firebox assembly 11 and, as will be appreciated, is an airtight compartment. Water is introduced under pressure into steam tank 14 through inlet pipe 47, discharging as a fine spray 48 from a conventional spray nozzle 49 onto heated block 50, a block that will retain heat, about 3 inches ×2 inches ×1 inch of low carbon steel. Thus, the water spray is converted by this "hot iron" into steam. As the entire steam tank is heated the inner surfaces thereof are quite hot and any water droplets or splashes from the heat retaining block not converted to steam are converted to steam as the water droplets or splashes hit the sides of the tank. Thus, a continuous and constant flow of steam, and at the desired pressure, is provided through steam line 51 which supplies steam turbine 52, shown in FIGS. 5 and 6 of the drawing.

As is usual, steam tank 14 is provided in its top surface with an outlet 53, connected to a conventional safety release valve (not shown). A drain (not shown) is provided from the bottom of steam tank 14 in which can be provided a manually operated valve, so that the steam tank can be drained should it become flooded at start-up or shut-down, or when the unit may otherwise malfunction. A built-in safety feature which can contribute to better and more efficient operation is to provide, according to conventional techniques, a pressure sensing solenoid valve that will cut off the water supply to the tank, should the steam tank cool down undesirably during operation from lack of sufficient fuel or temperature in the firebox.

Steam tank 14 can be of any non-corrosive material, stainless steel being preferred as this will offer not only long life but a tank of good structural qualities. However, it will be appreciated that any material of construction can be used provided it meets the specifications set forth.

The size of steam tank 14 will depend somewhat on the size of the overall heating unit, e.g., BTU's required, as well as upon the watts of electricity needed. In general, however, a tank which is approximately 15"×4"×4" will be found satisfactory for the production of 4000 watts/hour, at a steam pressure of 20 lbs./sq. in.$^2$ (psi). The water pressure, i.e., the pressure of water introduced into steam tank 14 must be, of course, somewhat greater, e.g., about 10 psi, than that of the steam.

Steam turbine 52, as will be seen more clearly by reference to FIGS. 5, 6, 7, and 8 of the drawing, comprises in its basic aspects a rotor 54 and a stator 55, the latter providing essentially with front and back covers 56, 57 a closed, circular-shaped compartment for the rotational travel, as shown by the direction of the arrow, of rotor 54. Covers 56, 57 can be bolted together by means of conventional bolts represented by reference numerals 58, providing a sealed compartment, as desired. As seen in reference to FIG. 6, steam from steam tank 14 enters steam turbine 52 under pressure at seal area 59, and is discharged from steam turbine 52 through discharge line 60 for a purpose as hereinafter more fully disclosed.

Figure 6:
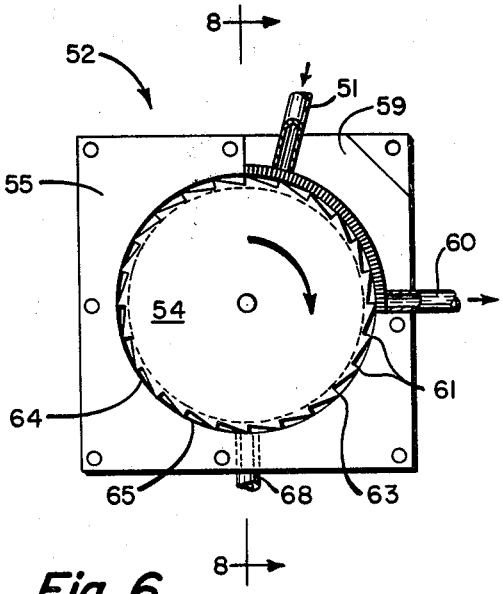
FIG. 6 is a side view of the steam turbine shown in FIG. 5 with the outside cover and seal ring removed so as to show the stator and rotor in operative combination.

Rotor 54, as seen in FIG. 6, is provided circumferentially with 16 spaced-apart teeth 61, each of which tapers downwardly, in a clockwise direction, as shown, from an outer rotor circumference, indicated by reference numeral 63, to an inner rotor circumference, 64. These teeth along with the circumferential boundary 65 of stator 55 in combination provide 16 individually sealed, sequential compartments or cavities.

As will be more fully appreciated in reference to FIG. 6, seal area 59 comprises, in general, the upper quadrant of stator 55. This area is mechanically adjustable inwardly, according to usual techniques, so that the seal is wiped by the outer extremities of rotor teeth 61. The seal is conventional honeycomb, used for this purpose, brazed onto the inner surface of the rotor quadrant. As shown, the inlet in steam turbine 52, for steam line 51, is so located that steam discharges in a cavity that is positively sealed, i.e., rotor teeth first contact brazed honeycomb upstream of the inlet.

Figure 7:
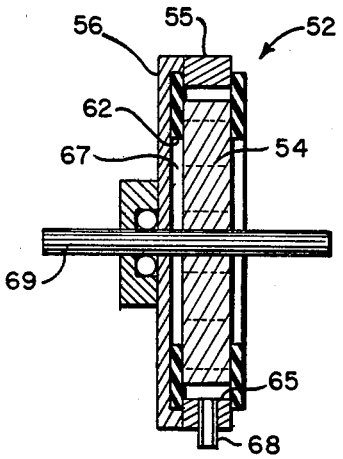
FIG. 7 is a view in cross-section of the steam turbine shown in FIG. 5 taken diametrically of the stator from top to bottom, the front cover being in position and the back cover of the turbine removed so as to better show the rotor and the annular seal and their relationship with the front and back covers.

As will be appreciated in reference to FIG. 7, front cover 56 is provided with annular-shaped cavity 67 for accommodating annular seal ring 62 which can be integral with rotor 54 (FIG. 8) or attached thereto, e.g., by screws or rivets. Though not shown, a similar cavity is provided in back cover 57, for the accommodation of the back side annular seal ring.

The size of steam turbine 52 will, of course, depend somewhat upon the electrical requirements, as well as upon the size of steam tank 14. However, I have found that a steam turbine dimensioned so that covers 56, 57 and stator 55 measure 11"×11" (outside dimensions) will be satisfactory. In this case, the overall width of the turbine will be $1\frac{7}{8}$", the rotor body 66 measuring $9\frac{7}{8}$" in diameter and having a thickness of $\frac{3}{4}$". Thus, each of the covers of the turbine will be approximately $\frac{3}{4}$". Annular seal rings 62 which are attached to rotor 54 each have a thickness of about $\frac{1}{8}$" and are so attached as to subscribe an outer diameter of $10\frac{3}{8}$". The inner diameters of seal rings 62 can obviously be any diameter desired so long as sufficient overlap with rotor body 66 is provided to offer good structural qualities and accommodation with the annular-shaped cavities in the front and back covers. Most importantly, however, is that whatever the dimensions of turbine 52, rotor 54 and stator 55, as well as the annular cavities in covers 56, 57, must be so dimensioned with respect to one another that not only will satisfactory rotation result but also a suitable seal be obtained. It will be appreciated that various seals can be used according to usual techniques, e.g., lead seal, or seals of conventional honeycomb. Any seal material can be used that is non-corrosive and that will provide a positive seal at the pressure and temperatures involved, e.g., 40 psi and 300° F.

Rotor 54, stator 55, and covers 56, 57 can be of various materials, as will be appreciated. However, aluminum castings will be found quite satisfactory for this purpose. Although in FIG. 1 of the drawing, steam turbine 52 is shown to be directly attached to hot air containment unit 12, this need not be the case. The turbine can be mounted at any suitable location on or off the heating unit so long as appropriate piping and connections are provided. No matter where the turbine is mounted, however, a drain line 68 should be provided therein, as indicated, in FIG. 6 of the drawing, for draining of condensed steam, as desired.

Figure 5:
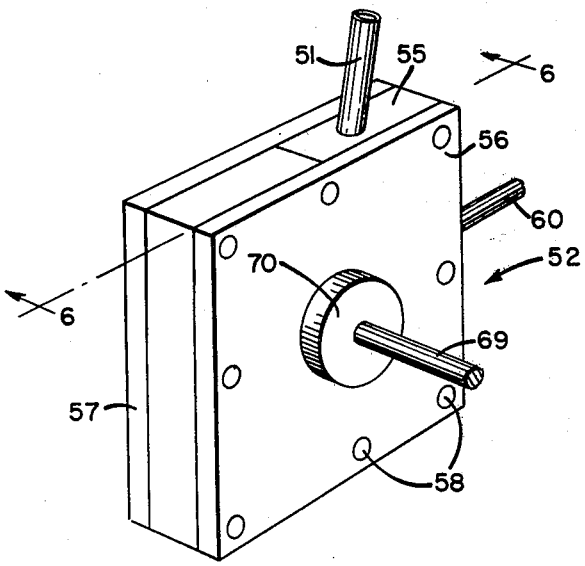
FIG. 5 is a view in perspective showing a steam turbine for use in the invention for the generation of electricity.

With rotation of rotor 54, drive shaft 69 in turn rotates, and as this is connected to a conventional electric generator (not shown) electricity will be produced. Drive shaft 69 which as shown in FIG. 5 extends perpendicularly from housing 70 (a similar housing is provided on both sides) as will be appreciated, is mounted in suitable bearings located in the housings, according to usual technique, and is in sealed connection to rotor 54 to, on rotation of rotor 54, provide axial rotation to shaft 69 with attendant operation of a generator (not shown) and the production of electricity in usual fashion. On shaft 69 is located a suitable flange, according to usual technique, to fit with and be joined to rotor 54 at the centrally located flange cut-out provided in rotor body 66. The size of the generator will need be coordinated with that of the steam turbine, etc., depending upon the electrical requirements. If desired, the electricity generated, instead of being used directly from generation, can be stored in batteries, as is conventionally done.

Figure 9:
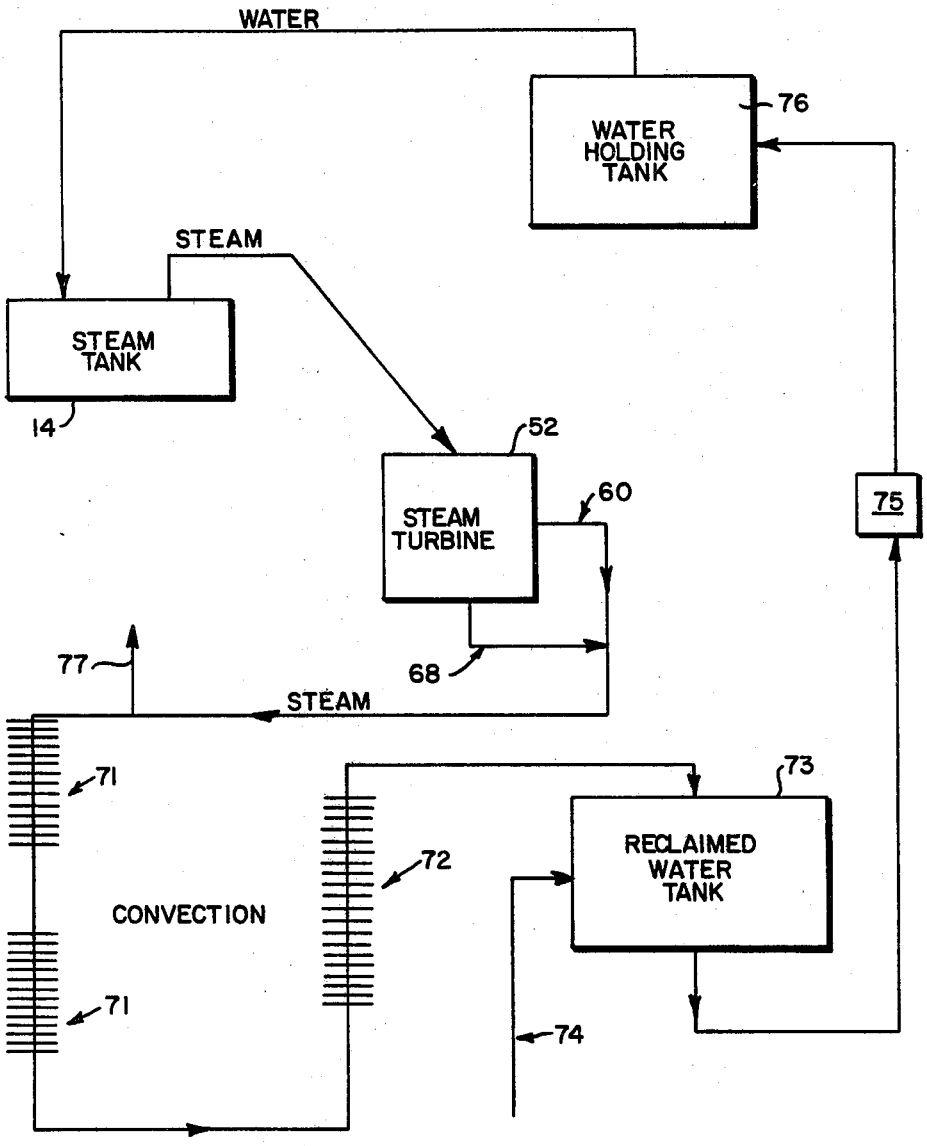
FIG. 9 is a schematic view showing the make-up of supply water for the steam turbine and its reclamation.

Steam expelled from steam turbine 52, as is shown by reference to FIG. 9, is piped to a suitable convection-type heater, e.g., as shown by reference numerals 71, 72, which in turn then, is piped to a vented tank 73. In tank 73 the steam is reduced back to water and this hot water then is used as a supply to steam tank 14. As indicated in FIG. 9, water can be added manually to the system through feed pipe 74 either in start-up, or as required in the system.

Reclaimed water is pumped by means of water pump 75 from vent tank 73 to water holding tank 76, in anticipation of supplying water to steam tank 14. Any pump will be found satisfactory for this purpose, provided such is capable of delivering water to water holding tank 76 at about 40 psi. The water, in general, will be held at 20–40 psi in the tank so that it can be delivered under the desired pressure to steam tank 14. As will be appreciated, suitable controls can be provided between water holding tank 76 and water pump 75 to provide on-off operation, as desired, and water at the desired pressure.

Figure 14:
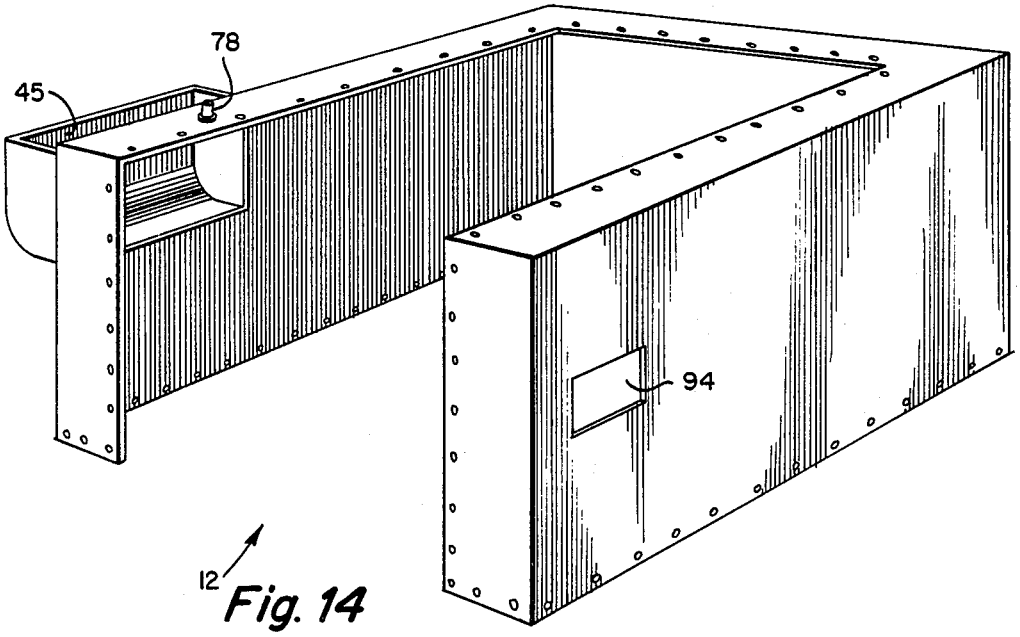
FIG. 14 is a view in perspective of the hot air containment unit of the total energy heating unit of the invention shown in FIG. 1 removed from the firebox assembly and base assembly.

If desired, and to maintain the heated air from hot air containment unit 12 at the desired humidity, steam line scavenger tube 77 can be connected into the heated air discharge from hot air containment unit 12, as shown by reference numeral 78 (FIG. 14). Thus, the desired moisture can be added to the heated air and air too dry can be readily avoided. An appropriate humidity sensing means and control valve can obviously be provided, if desired, all of which is conventional in the art of humidity control. Drain line 68, as is shown in FIG. 9 can be connected into line 60 from steam turbine 52; however, this need not necessarily be the case.

As will be appreciated, convection heaters 71, 72 serve a dual purpose. These convection heaters not only serve to aid the reduction of steam to water but they also can function as space heating means, in addition to the forced hot air heat supplied by heating unit 10. Thus, if the steam is piped to an unheated area, these convections will then act as a conventional steam convection heating system.

Figure 8:
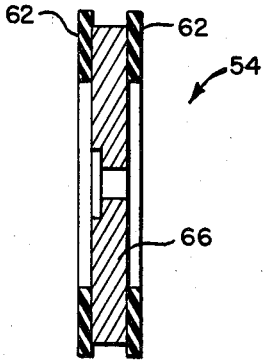
FIG. 8 is a view in cross section of the rotor shown in FIG. 6 taken at secant lines 8—8.
Figure 10:
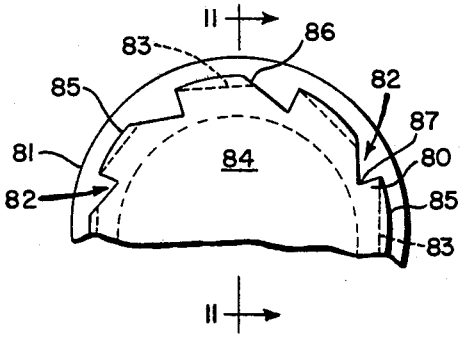
FIG. 10 is a side view of a portion of a further embodiment of a rotor that can be used in the steam turbine in the practice of the invention.
Figure 11:
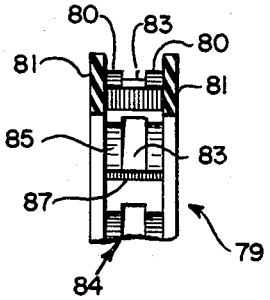
FIG. 11 is a view in cross section of the rotor of FIG. 10 taken at secant lines 11—11.

Rotors of a construction other than the one disclosed in FIG. 8 can, if desired, be used in the practice of the invention, particularly if somewhat greater steam capacity is required. In FIG. 10 there is disclosed the upper part of a rotor 79 which, like rotor 54, comprises a plurality of teeth 80, located equidistantly around its circumference. Annular rings 81, as before, are provided on each side of the rotor, at its outer circumference. As will be seen in referring to the drawing, these teeth provide 8 cavities 82, each being immediately preceeded by an open-top, elongated, pressure slot 83 of rectangular-cubic construction, the center-line of the bottom of which is located on the circumferential center line of the rotor body 84. The base of slot 83, as can be seen from FIG. 10 of the drawing, tapers downwardly toward the forwardly located cavity 82, from the outer diameter 85 of the rotor, to the inner diameter 86. Thus, slot 83 can slope downwardly at an angle from the vertical of e.g., from 45°–60°, resulting in a pressure slot measuring about $5/16'' \times \frac{1}{4}'' \times 1\frac{1}{2}''$. Cavity 82 tapers downwardly at an angle of about 60° from outer diameter 85 to inner diameter 87, terminating at the start of the next forward pair of teeth, the rear limit of which is determined by a radial segment, as shown. It will be appreciated that a pressure slot portion and a cavity subtend equal angles; however that a pressure slot empties into a cavity. Such a rotor construction will result in considerably greater capacity than that of rotor 54, e.g., as much as 40% more.

Figure 12:
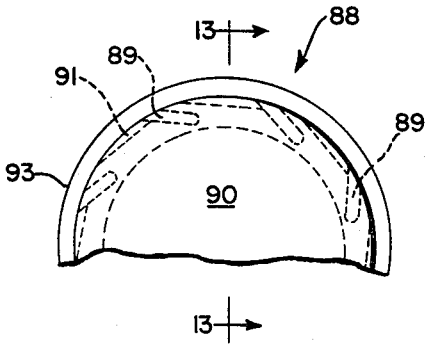
FIG. 12 is a side view of a further embodiment of a part of a rotor that can be used in the practice of the invention.
Figure 13:
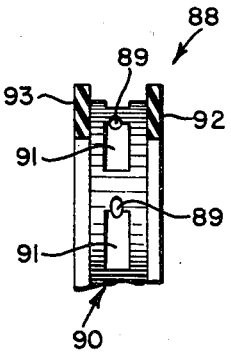
FIG. 13 is a cross sectional view of the rotor shown in FIG. 12 taken at secant lines 13—13.

A further rotor construction, and one which will provide about 20% greater capacity than rotor 54, is shown in FIGS. 12, 13 . In these figures there is disclosed a rotor 88 having a plurality of round-bottomed, circular-shaped ($\frac{5}{8}''$–$\frac{3}{4}''$ dia.) dead bore cavities 89, e.g., 8, located equidistantly circumferentially around the rotor body 90, each preceded by a pressure slot 91, as before-described. Cavities 89 are directed inwardly from the circumference at an angle of 60° from the vertical and extend to a length of about $1\frac{1}{2}$ inches. The pressure slots each extend from a point located $1\frac{1}{2}$ inches circumferentially from the cavity center line from the circumference inwardly at an angle of 60°. On each side of rotor body 90, as can be seen by reference to FIG. 13 of the drawing, there are provided annular seal members 92, 93 which in assembly with stator 55 are located in the annular cavities in the front and back covers, as previously described in connection with descriptions of rotor 54. As previously disclosed in the case of rotor 54, seal 59 will be adjusted mechanically in usual fashion, by set screws or the like, so that its honeycombed face will be wiped by the rotor circumference.

Turning now to FIG. 14, there is disclosed somewhat more clearly that skeletal construction which, in combination with firebox assembly 11 and base assembly 15 becomes hot air containment unit 12. As disclosed earlier, this unit can be assembled with and bolted to L-shaped flanges 25 and 32, to provide an airtight assembly.

Fan 41, as will be appreciated in reference to FIGS. 1 and 14, fits into rectangular-shaped opening 94, and supplies outside air to be heated for the centrally located hot air system portion of the invention. Any commercial squirrel cage fan will suffice for this purpose, provided it is sufficiently large enough to provide the desired amount of circulating air. Though not shown in the drawing, fan 41 will be operatively controlled in usual fashion by a conventional thermostat located in the area to be heated, and will be wired through a thermal switch located within the air chamber which prevents the fan from operating when chamber air temperature is less than 110° F.

Fan 24, also a conventional squirrel caged fan is controlled by a pressure switch located (not shown) in steam line 51. Thus, an adequate flow of forging air will be provided for a fire maintenance to generate steam at generally from about 20 to 30 psi. This fan will be wired to turn on when the steam pressure is below 20 psi and to turn off when the pressure is 30 psi, or some other pressure, as desired. The pressure switch can be provided with an appropriate toggle switch, if desired, so that it can be turned off in the event electricity is not needed, e.g., particularly if on vacation or the like. In this case, the thermal switch can nevertheless be so wired as to operate the forging air fan as required for heating.

As fan 24 operates to supply forging air through base assembly 15, much less air will be required from this fan than in the case of fan 41 used to supply forced air heat around the firebox and through the distribution air ducts. Accordingly, a 1/32nd horsepower model fan will, in general, be found satisfactory. The size of fan 41 will depend somewhat on the overall size of heating unit 10 and the BTU requirements.

Figure 15:
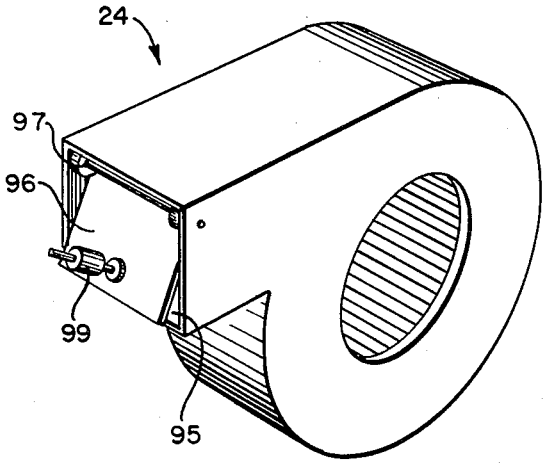
FIG. 15 is a view in perspective of a fan such as is suitable for use in combination with the hot air containment unit or the base assembly showing the damper control mechanism.
Figure 16:
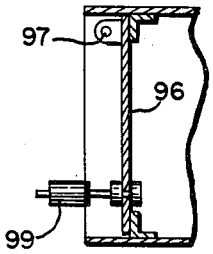
FIG. 16 is a side view of the damper mechanism located in the discharge of the fan shown in FIG. 15.

To insure that forging air is supplied by fan 24 only when actually desired, it is preferred to provide in the outlet 95 (see FIGS. 15, 16) of fan 24 a positive shut-off to air flow. Thus, a baffle door 96, supported at the top by hinge mechanism 97 to open and close, can be provided in the discharge outlet 95 of the fan. This door can be weighted as at 99, in usual fashion to provide positive shut-off. Thus, with a lack of forging air from fan 24, the firebox being airtight, any fire therein will eventually and relatively quickly be extinquished.

Figure 17:
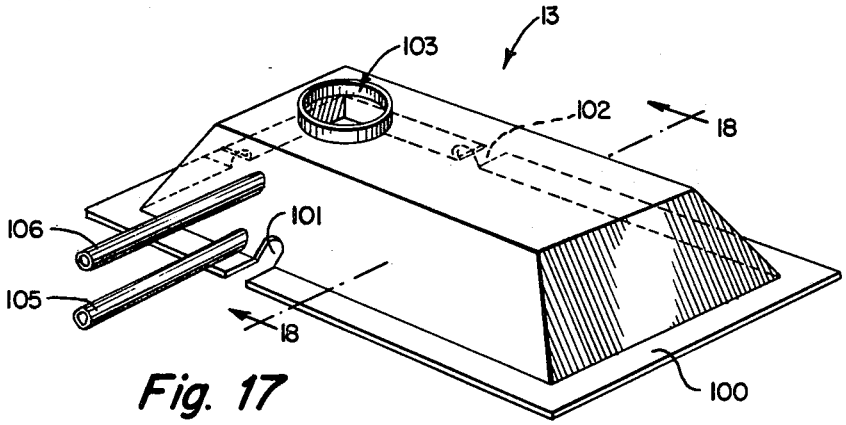
FIG. 17 is a view in perspective of the top cover associated with the top of the firebox assembly.
Figure 18:
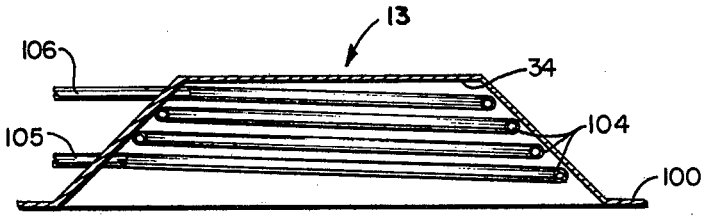
FIG. 18 is a view in cross section taken at secant lines 18—18 of the top cover shown in FIG. 17 showing the hot water circulating tubes surrounding the top of the firebox assembly.
Figure 19:
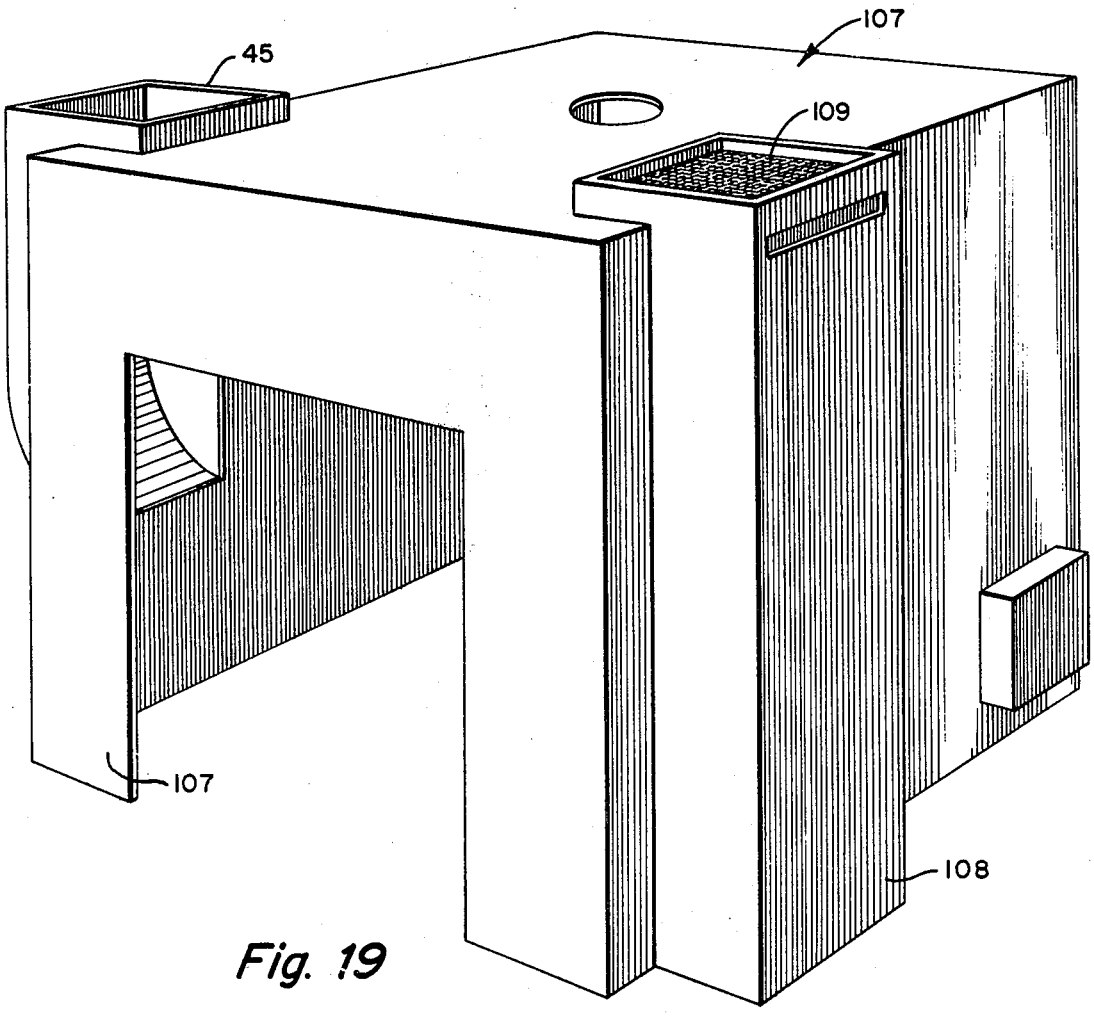
FIG. 19 is a view in perspective of the outside insulation that covers all but the front of the firebox and clean-out door of the base assembly, the steam turbine, forced air fan, and necessary pipes and ducting that must extend outwardly.

Referring now to FIG. 17 of the drawing there is disclosed top cover 13 which is positioned, as shown in FIG. 1 of the drawing, over top surface 34 of firebox assembly 11. As seen from the drawing, top cover 13 is provided with a flange 100 by means of which it is bolted in appropriate fashion to the top of hot air containment unit 12 and firebox assembly 11. Top cover 13 is provided with suitable cutouts 101, 102 for water inlet 47 and steam outlet 51, and circular shaped opening 103 for flue 35. This cover, in cross section, as can be seen by reference to FIG. 18, is of a trapezoidal shape, and forms with top surface 34 of the firebox assembly an enclosure or heat chamber for water circulating pipes, represented by reference numeral 104. Thus, cold water is introduced into the heated enclosure at point 105 and is hot water discharged at point 106, the continuous length tubing or water pipe meanwhile surrounding top 34 a number of times being sufficient to heat the circulating water to the desired temperature. Hot water from the enclosure can be piped to a conventonal insulated hot water holding tank (not shown) for use as desired. The hot water tubing can be, of course, supported in the enclosure and held in place by various means, e.g., steel clips attached to either the firebox assembly or inside of top cover 13.

The size of the various components used in the construction of the heating unit invention herein disclosed will, of course, depend somewhat upon the heating requirements desired, as well as the electrical requirements. And this will depend somewhat upon the residential structure or the like to be heated. Various materials of construction can obviously be used as are conventionally used in stove and furnace construction. The firebox assembly and base assembly unit are desirably of ⅛ inch steel welded fabrication. And steam tank 14 should be of a material that will withstand tests for 500 psi, preferably ½" stainless steel.

Air baffles 39, 40 having a width of about 4 inches have been found quite satisfactory in the invention, these being provided with circular-shaped openings spaced along their length 2 inches in diameter, spaced 3 inches apart, center-to-center. The hot air containment unit can be of 1/16 inch steel welded fabrication, as can top cover 13. However, it will be appreciated that no criticality will be found in any particular materials of construction used for any of the components of the invention or in the sizes disclosed, unless actually set forth herein.

Heating unit 10 shown in FIG. 1 is desirably covered on its overall outside by suitable conventional insulation indicated generally by reference numeral 107, that covers everything but the front of firebox assembly 11 and the cleanout door 19 of base assembly 15. Steam turbine 52, as earlier disclosed, can be mounted on or off the heating unit; however, it preferably will be mounted outside the insulation cover 107. As shown in the drawing, a suitable vented housing 108 can be provided outside insulation 107, if desired, for housing fan 41 and in that housing will be provided in the air intake on slides according to conventional practice, a replaceable air filter 109. If desired, a similar housing can be provided for fan 24.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What I claim is:

1. Process for providing hot air for heating, hot water, and electricity from a single source of fuel comprising the following steps:

(a) burning a suitable fuel within a closed system for the generation of heat;

(b) providing forging air as needed to generate and to maintain said heat;

(c) introducing water under pressure into a closed tank heated by said heat generated, for the generation of steam;

(d) operating a steam turbine operatively connected to an electrical generator, by the steam generated;

(e) passing air around said closed system whereby said air is heated and subsequently forced into a distribution system; and (f) circulating water around a portion of said closed system whereby the heat from the system generated is additionally used to heat the water.

2. Process for providing hot air for heating, hot water and electricity from a single source of fuel according to claim 1 wherein water introduced into said closed tank is introduced as a spray and said spray of water is projected against a heat retaining block.

3. Process for providing hot air for heating, hot water, and electricity from a single source of fuel according to claim 1 wherein said steam turbine discharges to a convection heater for the further providing of heat suitable for heating a desired space.

4. Process for providing hot air for heating, hot water, and electricity from a single source of fuel according to claim 1 wherein the steam turbine discharges to a vented tank and the steam is reduced to water, and said water then under pressure is used as a supply to the steam generating tank.

5. A total energy heating unit capable of providing heated air for space heating, hot water for use, and electricity comprising in combination:

(a) a firebox assembly for burning suitable fuel for generation of heat;

(b) means located within said firebox assembly for generation of steam;

(c) a steam turbine operatively connected to said means for generation of steam for generation of electricity;

(d) means surrounding said firebox assembly for containment of air whereby said air can be suitably heated and then supplied for heating a space as desired; and (e) means associated with said firebox assembly providing a heated enclosure and a tube located therein for the circulation of water in the heated enclosure whereby said water will be heated to a suitable temperature for use.

6. A total energy heating unit capable of providing heated air for space heating, hot water for use, and electricity according to claim 5 wherein said means for generating steam located in said firebox assembly comprises a sealed tank, an inlet in said tank for providing water to the steam tank under pressure, and an outlet from said tank for passage of steam to said steam turbine.

7. A total energy heating unit capable of providing heated air for space heating, hot water for use, and electricity according to claim 6 wherein a nozzle is provided in said water inlet line for providing water to the steam tank as a spray.

8. A total energy heating unit capable of providing heated air for space heating, hot water for use, and electricity according to claim 7 wherein a heat retaining block is located in said steam tank and said water spray is projected against the heat block.

9. A total energy heating unit capable of providing heated air for space heating, hot water for use, and electricity according to claim 5 wherein said heating unit further comprises a base assembly for supporting said firebox assembly and said hot air containment means.

10. A total energy heating unit capable of providing heated air for space heating, hot water for use, and electricity according to claim 9 wherein an opening is provided in the top of said base assembly, and an opening is provided in the bottom of said firebox assembly, these openings being co-extensive in size with one another and providing access between the two assemblies.

11. A total energy heating unit capable of providing heated air for space heating, hot water for use, and electricity according to claim 9 wherein an opening is provided in said base assembly for introduction of air.

12. A total energy heating unit capable of providing heated air for space heating, hot water for use, and electricity according to claim 11 wherein a fan is located in said opening for providing forging air to the burning fuel through said communicating openings in the base assembly and firebox assembly.

13. A total energy heating unit capable of providing heated air for space heating, hot water for use, and electricity according to claim 1 wherein said hot air containment means surrounds the firebox assembly on three sides, an opening being provided in one side of the hot air containment unit for the supply of fresh air, and an opening being provided in another side for the discharge of heated air.

14. A total energy heating unit capable of providing heated air for space heating, hot water for use, and electricity according to claim 13, wherein a fan is located within the said opening for supply of fresh air, for providing a sufficient supply of air to the hot air containment unit under pressure and for disharge from the said unit.

15. A total energy heating unit capable of providing heated air for space heating, hot water for use, and electricity according to claim 14 wherein baffles are provided within the hot air containment unit whereby to provide a disturbance to the flow of air through the unit, resulting in more efficient heating of the air.

16. A total energy heating unit capable of providing heated air for space heating, hot water for use, and electricity according to claim 5 wherein said steam turbine comprises a stator, a front and back cover sandwiching said stator there between, a cylindrical-shaped compartment in said stator and an annular cavity being provided in each of said front and back covers and communicating with the cylindrical-shaped compartment in the stator, and a rotor for rotational engagement within said stator.

17. A total energy heating unit capable of providing heated air for space heating, hot water for use, and electricity according to claim 16 wherein said rotor comprises a cylindrical-shaped body member, a plurality of teeth located circumferentially equidistantly around said body member, spaced-apart annular seal rings extending outwardly from the circumference of the body member and in cooperative engagement with the annular cavities in said covers, the said teeth being located between said annular seal rings and with said stator forming a sealed compartment for steam.

18. A total energy heating unit capable of providing heated air for space heating, hot water for use, and electricity according to claim 17 wherein said teeth taper downwardly from an outer rotor diameter to an inner rotor diameter.

19. A total energy heating unit capable of providing heated air for space heating, hot water for use, and electricity according to claim 18 wherein a pressure slot comprising an open top, elongated, rectangular, cubic-shaped slot precedes each said sealed compartment and communicates therewith.

20. A total energy heating unit capable of providing heated air for space heating, hot water for use, and electricity according to claim 16 wherein each said rotor comprises a cylindrical-shaped body member mounted centrally for rotation within the stator, a plurality of dead bores being located in the circumference of said cylindrical-shaped body member and spaced equidistantly from one another around the circumference, annular-shaped seal rings spaced in opposition to one another on opposite sides of the said body member, said rings extending beyond the circumference of the body member, and a plurality of open top, rectangular, cubic-shaped slots being provided in said circumference, each said slot communicating with a dead bore immediately in front of it.

21. A total energy heating unit capable of providing heated air for space heating, hot water for use, and electricity according to claim 5 wherein the shape of the top surface of the firebox assembly is trapezoidal in cross-section and said circulating water tube surrounds said top surface.

* * * * *